US011440027B2

(12) United States Patent
Rölver et al.

(10) Patent No.: US 11,440,027 B2
(45) Date of Patent: Sep. 13, 2022

(54) METHOD FOR OPERATING A CENTRIFUGAL SEPARATOR

(71) Applicant: HENGST SE, Münster (DE)

(72) Inventors: Martin Rölver, Havixbeck (DE); Michael Reimann, Emsdetten (DE); Stefan Robert, Nordwalde (DE)

(73) Assignee: Hengst SE, Münster (DE)

( * ) Notice: Subject to any disclaimer, the term of this patent is extended or adjusted under 35 U.S.C. 154(b) by 32 days.

(21) Appl. No.: 16/610,258

(22) PCT Filed: May 22, 2018

(86) PCT No.: PCT/EP2018/063276

§ 371 (c)(1),
(2) Date: Nov. 1, 2019

(87) PCT Pub. No.: WO2018/215398

PCT Pub. Date: Nov. 29, 2018

(65) Prior Publication Data

US 2020/0147623 A1 May 14, 2020

(30) Foreign Application Priority Data

May 24, 2017 (DE) ..... 102017111479.3

(51) Int. Cl.

| | |
|---|---|
| ***B04B 9/10*** | (2006.01) |
| ***F01M 13/04*** | (2006.01) |
| ***G10K 11/00*** | (2006.01) |

(52) U.S. Cl.

CPC ..... *B04B 9/10* (2013.01); *F01M 13/04* (2013.01); *G10K 11/00* (2013.01); *F01M 2013/0422* (2013.01); *G10K 2210/121* (2013.01)

(58) Field of Classification Search

CPC .. B04B 9/10; F01M 13/04; F01M 2013/0422; G10K 11/00; G10K 2210/121

See application file for complete search history.

(56) References Cited

U.S. PATENT DOCUMENTS 5,146,505 A * 9/1992 Pfaff ..... F01N 1/065 381/86
5,919,123 A * 7/1999 Phillips ..... B04B 1/2016 494/7

(Continued)

FOREIGN PATENT DOCUMENTS

DE 69607208 T2 11/2000
DE 102006056134 A1 6/2007

(Continued)

OTHER PUBLICATIONS

International Search Report; priority document.
German Search Report; priority document.

*Primary Examiner* — Kurt Philip Liethen
(74) *Attorney, Agent, or Firm* — Greer, Burns & Crain, Ltd.

(57) ABSTRACT

A method for operating a centrifugal separator associated with a prime mover and/or a working machine. The centrifugal separator comprises at least one rotatably mounted rotor that can be rotated at a variable speed via a drive controlled by a control unit. The method is characterized in that the speed of the rotor is controlled according to the sound emissions of the prime mover and/or according to the sound emissions of the working machine.

19 Claims, 1 Drawing Sheet

(56) References Cited

U.S. PATENT DOCUMENTS

| | | | | |
|---|---|---|---|---|
| 6,095,964 | A | 8/2000 | Purvey | |
| 2005/0277538 | A1* | 12/2005 | Sherman | B01F 31/86 494/16 |
| 2006/0048761 | A1 | 3/2006 | Ekeroth et al. | |
| 2007/0138988 | A1 | 6/2007 | Takahashi et al. | |
| 2009/0118111 | A1* | 5/2009 | Baumann | B04B 5/005 494/84 |
| 2010/0261595 | A1* | 10/2010 | Schaefer | B25J 11/00 494/20 |
| 2013/0283967 | A1* | 10/2013 | Movlazada | F16F 15/1214 74/574.2 |
| 2014/0018227 | A1* | 1/2014 | Andersson Aginger | B04B 5/12 494/43 |
| 2017/0056893 | A1* | 3/2017 | Eberle | B04B 7/02 |
| 2017/0203307 | A1 | 7/2017 | Fleuter et al. | |

FOREIGN PATENT DOCUMENTS

| | | | |
|---|---|---|---|
| EP | 0344443 | A2 | 12/1989 |
| EP | 1532353 | B1 | 11/2009 |
| EP | 1537301 | B1 | 11/2009 |
| EP | 2465613 | A1 | 6/2012 |
| WO | 2016008755 | A1 | 1/2016 |

* cited by examiner

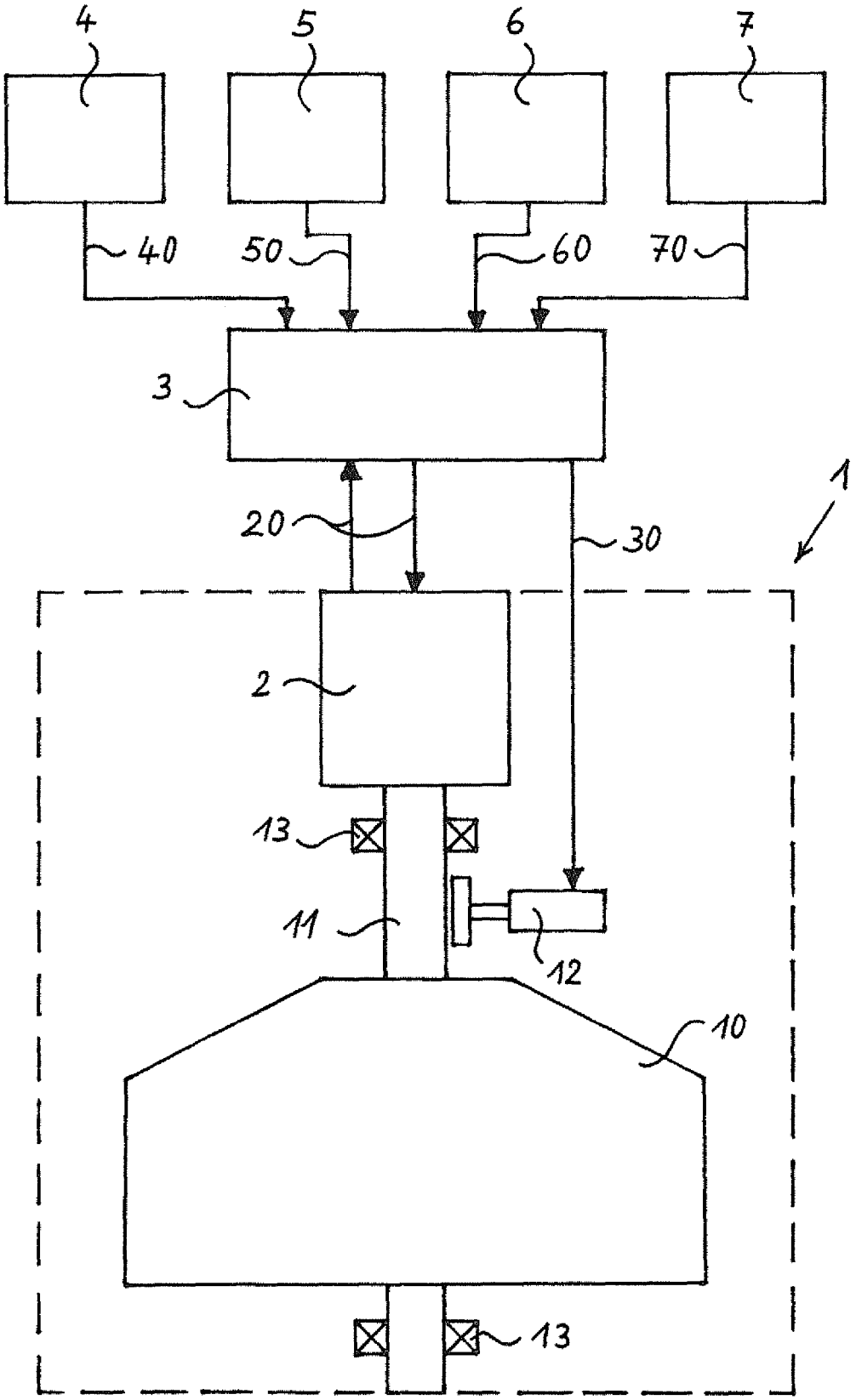
4
5
6
7
40
50
60
70
3
1
20
30
2
13
11
12
10
13

METHOD FOR OPERATING A CENTRIFUGAL SEPARATOR

CROSS-REFERENCES TO RELATED APPLICATIONS

This application claims the benefit of the International Application No. PCT/EP2018/063276, filed on May 22, 2018, and of the German patent application No. 10 2017 111 479.3 filed on May 24, 2017, the entire disclosures of which are incorporated herein by way of reference.

FIELD OF THE INVENTION

The present invention relates to a method for operating a centrifugal separator that is associated with a prime mover and/or working machine, the centrifugal separator having at least one rotatably mounted rotor that is set into rotation with a variable rotational speed by a drive controlled by a control unit.

BACKGROUND OF THE INVENTION

Methods of the type named above are known from EP 1 537 301 B1 and from EP 1 532 353 B1. These documents describe methods for cleaning crankcase gas produced during the operation of an internal combustion engine that is used to drive a vehicle. There, a centrifuge having a centrifuge rotor that is fastened on a vehicle for cleaning crankcase gas, and an electric motor for rotating the centrifuge rotor, are used, the electric motor being connectable for its operation to a power source present in the vehicle. A separating efficiency of the centrifuge is modified by changing the rotational speed of the electric motor and thus of the centrifuge rotor while the internal combustion engine continues to be operated. The rotational speed of the electric motor is modified, in particular, on the basis of data that represent an actual change of the quantity of crankcase gas produced by the internal combustion engine, or on the basis of the acquired change in a crankcase gas flow resulting from the production of crankcase gas by the internal combustion engine, or on the basis of an acquired change in a crankcase gas pressure produced as a result of the production of crankcase gas by the internal combustion engine. This is intended to bring it about that the centrifuge rotor is driven with the least possible drive energy necessary to meet requirements, that a good cleaning of the crankcase ventilation gas is ensured, and that no unnecessary, excess drive energy is applied for these purposes.

Modern centrifugal separators are often operated at high rotational speeds of several tens of thousands of rotations per minute, which provides a good cleaning effect, but is always accompanied by significant acoustic emissions, particularly in the range of higher frequencies that are unpleasant for human hearing, and which cause disturbance and stress for people situated nearby. These acoustic emissions are caused, in particular, by rotor imbalances, by the rotor bearing, and by the rotor drive. The acoustic emissions of the centrifugal separator are particularly disturbing when other, accompanying acoustic emissions that partly mask the noise of the centrifugal separator cease, the centrifugal separator then remaining audible for a long time due to the temporally relatively long running out/running down time of the rotor, due to its high initial rotational speed. In addition, when the rotor is running out/running down its rotational energy goes unused.

SUMMARY OF THE INVENTION

An object therefore arises for the present invention of providing a method of the type named above that prevents, or at least significantly reduces, disturbance and stress to people located in the vicinity of centrifugal separators in a prime mover and/or working machine. In addition, the method should make it possible to make use of the rotational energy of the rotor when it is running out/running down.

This object is achieved according to the present invention by a method of the type named above, characterized in that the rotational speed of the rotor is controlled as a function of the acoustic emissions of the prime mover and/or as a function of the acoustic emissions of the working machine.

According to the present invention, the essential criteria according to which the controlling of the rotational speed of the rotor of the centrifugal separator takes place are the acoustic emissions of the prime mover and/or of the working machine to which the centrifugal separator is assigned, ensuring an operation of the centrifugal separator that is acoustically not noticeable in the sound environment of the prime mover and/or of the working machine, and that acoustically will not disturb people in the vicinity of the centrifugal separator.

In a further preferred embodiment, for the method according to the present invention, it is provided that the controlling of the rotational speed of the rotor takes place in such a way that the rotor is operated with a maximum rotational speed such that, amid the acoustic emissions currently emanating from the prime mover or the working machine, the centrifugal separator is not audible to human hearing. As a result, the centrifugal separator disappears acoustically from perception by people in the surrounding environment, so that disturbance and stress, or even mere annoyance, can be excluded.

It is advantageously provided that signals that represent the acoustic emissions of the prime mover or of the working machine and that are to be supplied to the control unit are ascertained from at least one operating parameter that is already stored or acquired for a different purpose at the prime mover or working machine. This has the advantage that a separate sensor system is not required for acquisition of the current acoustic emissions.

A development in this regard provides that the operating parameter from which the signals to be supplied to the control unit are ascertained is the current prime mover operating point in a stored prime mover operating characteristic map. Because today's prime mover machines, such as internal combustion engines, are standardly operated using electronic data from a stored operating characteristic map, these characteristic map data, which as a rule also have a determinate correlation with the acoustic emissions of the machine, can be used to obtain or produce control data for driving the rotor of the centrifugal separator.

In a more specific embodiment of the method, it is proposed that the at least one acquired operating parameter from which the signals to be supplied to the control unit are ascertained is a rotational speed measurement value and/or a load value of the prime mover.

Alternatively or in addition, it is possible for the acquired operating parameters from which the signals to be supplied to the control unit are ascertained to be a speed of movement of the working machine and/or a transmission gear that is set in a transmission of the working machine.

A further alternative or additional possibility is that the operating parameters from which the signals to be supplied to the control unit are ascertained are stored, speed-dependent wind noises and/or rolling noises of the working machine.

For the method according to the present invention, it is further proposed that the parameters from which the signals to be supplied to the control unit are ascertained are generated from an onboard electrical network and/or bus network of the prime mover or the working machine and are supplied to the control unit, and that the control unit, formed by an electronics unit integrated in the centrifugal separator, takes over the controlling of the rotational speed of the rotor of the centrifugal separator in accordance with characteristic values pertaining to the control signals, stored in the control unit. In this way, use is advantageously made of an onboard network or bus network that is already present in many prime movers or working machines, thus keeping the hardware and software outlay for the control unit low.

According to another embodiment of the method according to the present invention, it is possible that signals that represent the acoustic emissions of the prime mover or of the working machine and that are to be supplied to the control unit are acquired by one or more acoustic sensors. In this way, within the method the actually occurring acoustic emissions can be immediately acquired, and the method can be carried out independently of data that are present or acquired for other purposes.

It is possible for a microphone, such as a telephone or hands-free device, that is present in or on the prime mover or working machine to be used as the acoustic sensor, or as one of the plurality of acoustic sensors.

In addition, as the drive of the rotor an electrical drive is preferably used that is switched over by the control unit between an operating mode in which it drives the rotor and an operating mode in which it brakes the rotor and a switched-off mode, in accordance with the signals supplied to the control unit. Using the electrical drive, the rotor can be acted on in any desired manner with regard to its rotational speed.

The method offers the advantageous possibility that in the operating mode in which the electrical drive brakes the rotor, electrical energy is produced by the electrical drive and is fed back into an electrical network of the prime mover or working machine. This contributes to a particularly high degree of energy efficiency in the operation of the centrifugal separator.

In an alternative embodiment of the method, as the drive of the rotor a hydraulic drive is used that is switched at least between a driving operating mode and a switched-off state by the control unit, in accordance with the signals supplied to the control unit.

In addition, it can be provided that when there is a need for a reduction of the rotational speed of the rotor, the hydraulic drive can be switched over by the control unit into a braking operating mode, in accordance with signals supplied to the control unit.

Alternatively, and independent of the type of rotor drive, when there is a need for a reduction of the rotational speed of the rotor, a separate brake device assigned to the rotor can be activated by the control unit. The brake device is then, for example, a mechanical brake device that brings about a reduction in the rotational speed of the rotor as needed, using friction.

In order to enable, within the method, a braking of the rotor as needed with as fast a reaction as possible and with as little delay as possible, it is proposed that in accordance with signals supplied to the control unit by a machine control device of the prime mover or working machine before an impending stop, signaled by the control device, of the prime mover or working machine, the control unit brings the rotor to a standstill before or up until the stopping of the prime mover or working machine takes place. In this way, the acoustic emissions of the centrifugal separator remain unnoticeable and without disturbing effect for people in the surrounding environment, even during demanding operating moments.

Preferably, the method according to the present invention is used in a prime mover formed by an internal combustion engine, because here particularly great benefit can be achieved, because it is frequently the case that, during operation of the internal combustion engine, people will be situated, or will have to be situated, in the vicinity of a centrifugal separator assigned to this internal combustion engine.

An additional beneficial use of the method according to the present invention in connection with an internal combustion engine is that in accordance with signals provided to the control unit by a control device of the internal combustion engine before an impending start, signaled by the control device, of the internal combustion engine, the control unit activates the drive of the rotor for a pre-evacuation of the crankcase of the internal combustion engine before the start of the internal combustion engine takes place. This advantageously reduces the energy requirement of a starter that starts the internal combustion engine. The use indicated here of the method is also technically beneficial in connection with active crankcase ventilation systems having electrically, hydraulically, or pneumatically driven ventilators or compressors or controlled suction jet nozzles.

A further preferred and advantageous use of the method is that it is used in a working machine formed by a motor vehicle. Here as well, a particularly great benefit is achieved, because during operation of the motor vehicle its driver, and passengers that may be present, must in any case spend time in the vicinity of a centrifugal separator associated with this motor vehicle and the internal combustion engine that in most cases is present in the vehicle.

Through the method of the present invention, persons, such as those traveling in motor vehicles, are effectively protected from stress-inducing noises of centrifugal separators, while at the same time the function of the centrifugal separator is however not noticeably impaired, because the separator itself can also be operated in operating states having louder acoustic emissions in phases in which the ambient volume is higher, without this being perceived or experienced as disturbing by people in the surrounding environment.

Finally, a particularly advantageous use of the method according to the present invention is that it is used to operate a centrifugal separator that removes oil from crankcase ventilation gas, or cleans lubricant oil, in an internal combustion engine of a hybrid vehicle or a motor vehicle having an engine start-stop automated system. In such motor vehicles, phases occur particularly frequently in which the internal combustion engine is at a standstill, and then does not itself produce any acoustic emissions. Therefore, a conventionally operated centrifugal separator would be particularly disturbing in this case; however, this is reliably prevented by the method according to the present invention.

Overall, with the method according to the present invention and its embodiments, an improved, non-disturbing acoustic characteristic of the centrifugal separator, and better durability with longer lifespan and reduced energy consumption for the drive of the rotor of the centrifugal separator, are achieved. A fast runup of the rotor is enabled, and, due to the controlling of the rotor rotational speed, critical rotational speed regions, in particular in the area of resonant frequencies of the rotor, are quickly traveled through, permitting larger imbalances of the rotor, which can be realized, for example, in the form of a plate separator, and higher maximum rotational speeds of the rotor.

BRIEF DESCRIPTION OF THE DRAWINGS

In the following, an exemplary embodiment of the present invention is explained on the basis of a drawing.

The single FIGURE of the drawing shows, in a purely schematic representation, a centrifugal separator having a rotor with a drive, and having a control unit that controls the drive in accordance with a plurality of control parameters.

DETAILED DESCRIPTION OF THE PREFERRED EMBODIMENTS

In its lower part, the FIGURE schematically shows a centrifugal separator 1 having a rotor 10 realized, for example, as a plate stack separator. Rotor 10 is rotatably mounted, by a rotor shaft 11 and two rotor bearings 13, in a separator housing not shown separately here. Using a drive 2 connected to rotor shaft 11, such as an electric motor, rotor 10 can be set into rotation during operation of centrifugal separator 1, in order to use centrifugal force to separate droplets or particles of a second medium out from a first medium flowing through rotor 10, in a known manner.

In addition, the exemplary embodiment shown here of centrifugal separator 1 includes a brake 12 that can exert a braking force on rotor shaft 11 and thus also on rotor 10 as needed, using friction. Alternatively, brake 12 can also be an electric brake, possibly having energy recuperation.

Centrifugal separator 1 is assigned to a prime mover or working machine not further shown in the drawing, for example an internal combustion engine of a motor vehicle, and can, for example, be used specifically for removing oil from crankcase ventilation gas of the internal combustion engine.

An electronic control unit 3 is assigned to centrifugal separator 1, which control unit controls drive 2 of rotor 10 of centrifugal separator 1 with a variable rotational speed, via electrical signal and supply connections 20, in accordance with parameters explained below. Via the electrical signal connection 20, control unit 3 acquires the current actual rotational speed of drive 2, and thus of rotor 10, and compares this to the current target rotational speed, calculated as a function of parameters, in order to correspondingly increase or reduce the actual rotational speed in case of deviations. Via a further electrical signal connection 30, control unit 3 activates brake 12 when there is a need for a reduction in the rotational speed of rotor 10.

A first parameter used to control the rotational speed of drive 2 of rotor 10 in the exemplary embodiment shown in the drawing is the rotational speed of an associated internal combustion engine. This rotational speed is acquired via an internal combustion engine rotational speed sensor 4 indicated at the top in the FIGURE, and is communicated to control unit 3 as a measurement signal, via a further electrical signal connection 40.

A further source for one or more further control parameters that are supplied to control unit 3 is an engine control device 5 of the associated internal combustion engine. In modern internal combustion engines, engine control devices that acquire or have stored various operating parameters of the internal combustion engine are already present anyway, and can here additionally be used for the controlling of drive 2. Here, suitable data or signals are transmitted to control unit 3 by engine control device 5 via signal connection 50.

A further parameter used to control drive 2 is the speed of an associated vehicle, such as a motor vehicle having an internal combustion engine. Using a vehicle speed sensor 6, the speed of the vehicle is ascertained and is supplied to control unit 3 as measurement signal via a further signal connection 60.

Finally, in the exemplary embodiment a further acoustic sensor 7 is provided that acquires noises or a noise level in the surrounding environment of centrifugal separator 1, for example in an internal compartment of the motor vehicle having an internal combustion engine equipped with centrifugal separator 1, and supplies these to control unit 3 as a measurement signal via a further signal connection 70.

Control unit 3 controls the rotational speed of rotor 10 as a function of signals supplied to control unit 3 that represent the acoustic emissions of the prime mover and/or of the working machine. In particular, the controlling of the rotational speed of rotor 10 takes place in such a way that rotor 10 is operated with a maximum rotational speed such that, amid the currently prevailing acoustic emissions of the associated prime mover and/or working machine, centrifugal separator 1 is not perceptible, or at least not disturbing, for human hearing.

Using drive 2, controlled by control unit 3, rotor 10 can be quickly accelerated and brought to a current desired rotational speed that is a function of parameters processed in control unit 3. Conversely, using the brake 12 provided here, also controlled by control unit 3, rotor 10 can be quickly braked as needed and brought to a lower rotational speed or to a standstill.

In practice, for the realization of the method it can also suffice to supply fewer different signals than are shown in the FIGURE to control unit 3. Conversely, it is also possible to use even more signals than those shown in the drawing for the controlling of drive 2 of rotor 10 by control unit 3.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCE CHARACTERS

1 centrifugal separator
10 rotor
11 rotor shaft
12 brake
13 rotor bearing
2 drive for 10
20 signal connection and/or supply connection between 2 and 3
3 control unit
30 signal connection of 3 to 12

4 internal combustion engine rotational speed sensor
40 signal connection of 4 to 3
5 engine control device of the internal combustion engine
50 signal connection of 5 to 3
6 vehicle speed sensor
60 signal connection of 6 to 3
7 acoustic sensor
70 signal connection of 7 to 3

The invention claimed is:

1. A method for operating a centrifugal separator associated with at least one of a prime mover or a working machine in a motor vehicle, the centrifugal separator having at least one rotatably mounted rotor, the method comprising the steps:

setting the at least one rotatably mounted rotor into rotation with a variable rotational speed by a drive controlled by a control unit, and, adjusting the variable rotational speed of the at least one rotatably mounted rotor as a function of acoustic emissions of the at least one of the prime mover or the working machine such that the rotation speed of the at least one rotatably mounted rotor increases as the acoustic emissions of the at least one of the prime mover or the working machine increase and the rotation speed of the at least one rotatably mounted rotor decreases as the acoustic emissions of the at least one of the prime mover or the working machine decrease.

2. The method as recited in claim 1, wherein the controlling of the rotational speed of the at least one rotatably mounted rotor takes place such that the at least one rotatably mounted rotor is operated with a maximum rotational speed such that acoustic emissions from the centrifugal separator are not perceptible to human hearing amid the respective current acoustic emissions of the at least one of the prime mover or the working machine.

3. The method as recited in claim 1, wherein signals that represent acoustic emissions of the at least one of the prime mover or the working machine and that are supplied to the control unit are ascertained from at least one operating parameter already stored or acquired at the at least one of the prime mover or the working machine for some other purpose.

4. The method as recited in claim 3, wherein the at least one of a prime mover or a working machine comprises prime mover, and wherein the at least one operating parameter from which the signals to be supplied to the control unit are ascertained is a current prime mover operating point in a stored prime mover operating characteristic map.

5. The method as recited in claim 3, wherein the at least one of a prime mover or a working machine comprises the prime mover, and wherein the at least one operating parameter from which the signals to be supplied to the control unit are ascertained is at least one of a rotational speed measurement value or a load value of the prime mover.

6. The method as recited in claim 3, wherein the at least one of a prime mover or a working machine comprises the working machine, and wherein the at least one operating parameter from which the signals to be supplied to the control unit are ascertained is at least one of a speed of movement of the working machine or a set transmission gear of a transmission of the working machine.

7. The method as recited in claim 3, wherein the at least one of a primer mover or a working machine comprises the working machine, and wherein the at least one operating parameter from which the signals to be supplied to the control unit are ascertained are at least one of stored, speed-dependent wind noises or rolling noises of the working machine.

8. The method as recited in claim 3, wherein the at least one operating parameter from which the signals to be supplied to the control unit are ascertained are generated and supplied to the control unit from at least one of an onboard network or bus network of the at least one of the prime mover or the working machine, and wherein the control unit, formed by an electronics unit integrated in the centrifugal separator, takes over the controlling of the rotational speed of the at least one rotatably mounted rotor of the centrifugal separator in accordance with characteristic values pertaining to the control signals, stored in the control unit.

9. The method as recited in claim 1, wherein signals that represent the acoustic emissions of the at least one of the prime mover or the working machine, and that are to be supplied to the control unit, are acquired by one or more acoustic sensors.

10. The method as recited in claim 9, wherein a microphone in or on the at least one of the prime mover or the working machine is used as the one or more acoustic sensors.

11. The method as recited in claim 1, wherein, for the drive of the at least one rotatably mounted rotor, an electrical drive is used that is switched over by the control unit, in accordance with signals supplied to the control unit, between a first operating mode in which the electrical drive drives the at least one rotatably mounted rotor and a second operating mode in which the electrical drive brakes the at least one rotatably mounted rotor, and a switched-off state.

12. The method as recited in claim 11, wherein in the operating mode in which the electrical drive brakes the at least one rotatably mounted rotor, electrical energy is produced by the electrical drive and is fed back into an electrical network of the at least one of the prime mover or the working machine.

13. The method as recited in claim 1, wherein as the drive of the at least one rotatably mounted rotor a hydraulic drive is used that is switched over by the control unit at least between a driving operating mode and a switched-off state, in accordance with signals that represent acoustic emissions of the at least one of the prime mover or the working machine supplied to the control unit.

14. The method as recited in claim 13, wherein when there is a need for a reduction in the rotational speed of the at least one rotatably mounted rotor, the hydraulic drive is switched over to a braking operating mode by the control unit in accordance with the signals supplied to the control unit.

15. The method as recited in claim 1, wherein when there is a need for a reduction in the rotational speed of the at least one rotatably mounted rotor, a separate brake device, assigned to the rotor or to a shaft of the at least one rotatably mounted rotor or to the drive, is activated by the control unit.

16. The method as recited in claim 1, wherein in accordance with signals that are supplied to the control unit by a machine control device of the prime mover or the working machine before an impending stop, signaled by the control device, of the prime mover or the working machine, the control unit brings the at least one rotatably mounted rotor to a standstill before or up until the stopping of the at least one of the prime mover or the working machine.

17. The method as recited in claim 1, wherein the at least one of a primer mover or a working machine comprises the prime mover, and wherein the steps are performed in the prime mover formed by an internal combustion engine.

18. The method as recited in claim 17, wherein in accordance with signals that are supplied to the control unit by a control device of the internal combustion engine before an impending start, signaled by the control device, of the internal combustion engine, the control unit activates the at least one rotatably mounted rotor for a pre-evacuation of a crankcase of the internal combustion engine before the start of the internal combustion engine takes place.

19. The method as recited in claim 1, wherein the steps are used to operate the centrifugal separator that removes oil from crankcase ventilation gas or cleans lubricant oil in an internal combustion engine of a hybrid motor vehicle or of a motor vehicle having an engine start-stop automated system.

* * * * *